US009692149B2

(12) United States Patent
Hashimoto

(10) Patent No.: US 9,692,149 B2
(45) Date of Patent: Jun. 27, 2017

(54) COAXIAL CONNECTOR AND CONNECTING SECTION

(71) Applicant: MURATA MANUFACTURING CO., LTD., Kyoto-fu (JP)

(72) Inventor: Susumu Hashimoto, Nagaokakyo (JP)

(73) Assignee: Murata Manufacturing Co., Ltd., Kyoto-Fu (JP)

( * ) Notice: Subject to any disclaimer, the term of this patent is extended or adjusted under 35 U.S.C. 154(b) by 0 days.

(21) Appl. No.: 15/044,192

(22) Filed: Feb. 16, 2016

(65) Prior Publication Data

US 2016/0164199 A1 Jun. 9, 2016

Related U.S. Application Data

(63) Continuation of application No. PCT/JP2014/063450, filed on May 21, 2014.

(30) Foreign Application Priority Data

Aug. 22, 2013 (JP) ..... 2013-171898

(51) Int. Cl.
*H01R 9/05* (2006.01)
*H01R 24/38* (2011.01)
(Continued)

(52) U.S. Cl.
CPC ..... *H01R 9/0518* (2013.01); *H01R 24/38* (2013.01); *H01R 9/053* (2013.01); *H01R 9/0515* (2013.01); *H01R 2103/00* (2013.01)

(58) Field of Classification Search
CPC H01R 2103/00; H01R 9/0518; H01R 9/0515; H01R 24/40; H01R 24/545
(Continued)

(56) References Cited

U.S. PATENT DOCUMENTS 7,938,681 B2 * 5/2011 Lee ..... H01R 13/112 439/582
7,972,174 B2 * 7/2011 Maruyama ..... H01R 9/0518 439/582
(Continued)

FOREIGN PATENT DOCUMENTS

CN 101673908 A 3/2010
JP 2009-099478 A 5/2009
(Continued)

OTHER PUBLICATIONS

International Search Report—PCT/JP2014/063450 mailed Aug. 12, 2014.
(Continued)

*Primary Examiner* — Hien Vu
(74) *Attorney, Agent, or Firm* — Studebaker & Brackett PC

(57) ABSTRACT

A coaxial connector includes a housing, and a bushing which is attached to the housing and on which the leading end of the coaxial cable is placed. In the coaxial connector, the housing includes a first circular cylinder and a crimping portion holding the bushing, the bushing is press-contacted to an insulation film by a force from the crimping portion, a socket includes a contact portion enclosed by the first circular cylinder and an attachment portion that is press-contacted to the insulation film by a force from the bushing and is connected to a second central conductor through cutting and removing part of the insulation film, and a minimum length from the center of the first circular cylinder to the crimping portion is longer than a maximum length from the center of the outer conductor to an outer edge of the receptacle.

6 Claims, 8 Drawing Sheets

(51) Int. Cl.
*H01R 103/00* (2006.01)
*H01R 9/053* (2006.01)

(58) Field of Classification Search
USPC ..... 439/63, 582, 578
See application file for complete search history.

(56) References Cited

U.S. PATENT DOCUMENTS

| | | | | |
|---|---|---|---|---|
| 8,137,134 | B1 * | 3/2012 | Chang | H01R 9/0518 439/582 |
| 8,734,179 | B2 * | 5/2014 | Tsai | H01R 13/516 29/857 |
| 2010/0062640 | A1 | 3/2010 | Maruyama et al. | |
| 2014/0213107 | A1 * | 7/2014 | Himi | H01R 4/185 439/585 |

FOREIGN PATENT DOCUMENTS

| | | | |
|---|---|---|---|
| JP | 4362385 | B2 | 11/2009 |
| JP | 2010-067425 | A | 3/2010 |
| JP | 2010-108719 | A | 5/2010 |
| JP | 2012-109046 | A | 6/2012 |
| JP | 2012-243441 | A | 12/2012 |
| JP | 2013-097915 | A | 5/2013 |

OTHER PUBLICATIONS

Written Opinion—PCT/JP2014/063450 mailed Aug. 12, 2014.
International Preliminary Report on Patentability of the International Searching Authority; PCT/JP2014/063450 issued on Feb. 23, 2016.
An Office Action; "Notice of Reasons for Rejection," issued by the Japanese Patent Office on Jul. 5, 2016, which corresponds to Japanese Patent Application No. 2015-532731 and is related to U.S. Appl. No. 15/044,192; with English language translation.

* cited by examiner

COAXIAL CONNECTOR AND CONNECTING SECTION

CROSS REFERENCE TO RELATED APPLICATIONS

This application claims benefit of priority to Japanese Patent Application 2013-171898 filed Aug. 22, 2013, and to International Patent Application No. PCT/JP2014/063450 filed May 21, 2014, the entire content of which is incorporated herein by reference.

TECHNICAL FIELD

The present disclosure relates to coaxial connectors and connecting sections, and more specifically relates to a coaxial connector provided at a leading end of a coaxial cable and a connecting section.

BACKGROUND

As a disclosure relating to a conventional coaxial connector, an L-type coaxial connector disclosed in Japanese Unexamined Patent Application Publication No. 2012-109046 is known, for example. The stated coaxial connector is connected to a receptacle connector and includes a cylindrical contact portion, an engagement unit, and a central contact. The cylindrical contact portion is formed in a circular cylinder shape and fitted to a cylindrical terminal of the receptacle connector. The central contact is provided at the center of the cylindrical contact portion and makes contact with a central terminal of the receptacle connector. The engagement unit is provided at a side of the cylindrical contact portion and holds a coaxial cable.

The L-type coaxial connector constituted in the manner described above has a problem in that it cannot be rotated relative to the receptacle connector as explained below. For example, there is a case in which the L-type coaxial connector needs to be rotated relative to the receptacle connector in order to change the position of the coaxial cable connected to the L-type coaxial connector after the L-type coaxial connector and the receptacle connector have been connected to each other. Since the cylindrical contact portion and the cylindrical terminal are formed in a circular cylinder shape, the cylindrical contact portion can be rotated relative to the cylindrical terminal. However, the engagement unit is provided at a side of the cylindrical contact portion. As such, in the case where the L-type coaxial connector is rotated relative to the receptacle connector, there is a risk that the engagement unit is caught with the receptacle connector. Because of this, the L-type coaxial connector disclosed in Japanese Unexamined Patent Application Publication No. 2012-109046 cannot be rotated relative to the receptacle connector.

SUMMARY

Technical Problem

An object of the present disclosure is to provide a coaxial connector capable of rotating relative to a receptacle and a connecting section.

Solution to Problem

A coaxial connector according to an embodiment of the present disclosure is a coaxial connector that is attached to a leading end of a coaxial cable including an outside conductor and a second central conductor insulated from each other with an insulation film, and that is attachable/detachable to/from a receptacle including a first central conductor and an outer conductor which is formed in a circular cylinder shape and is provided on a circumference of the first central conductor. The stated coaxial connector includes a housing, a bushing which is attached to the housing and on which the leading end of the coaxial cable is placed, and a socket attached to the bushing and insulated from the housing by the bushing. In the coaxial connector, the housing includes a first circular cylinder and a crimping portion holding the bushing, the bushing is press-contacted to the insulation film by a force from the crimping portion, the socket includes a contact portion enclosed by the first circular cylinder and an attachment portion that is press-contacted to the insulation film by a force from the bushing and is connected to the second central conductor through cutting and removing part of the insulation film, the first circular cylinder is fitted onto the outer conductor and the contact portion is connected to the first central conductor, and a minimum length from the center of the first circular cylinder to the crimping portion when viewed from above in a central axis direction of the first circular cylinder is longer than a maximum length from the center of the outer conductor to an outer edge of the receptacle when viewed from above in a central axis direction of the outer conductor.

A connecting section according to an embodiment of the present disclosure includes the above coaxial connector and the receptacle on which the coaxial connector is mounted.

Advantageous Effects of Disclosure

According to the present disclosure, the coaxial connector can be rotated relative to the receptacle.

DETAILED DESCRIPTION

Hereinafter, a coaxial connector and a connecting section according to embodiments of the present disclosure will be described with reference to the drawings.

(Structure of Coaxial Connector)

Figure 1:
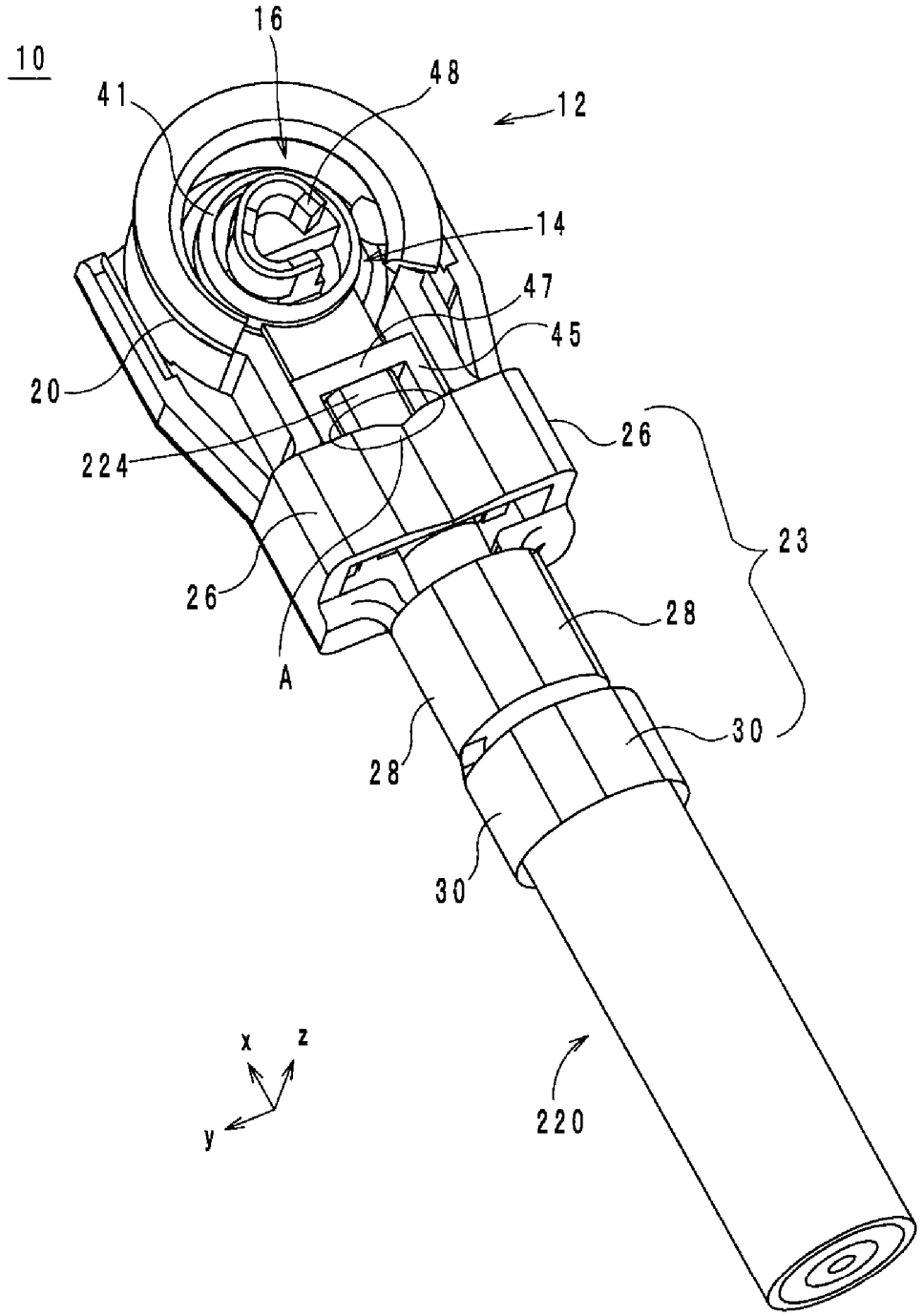
FIG. 1 is an exterior appearance perspective view of a coaxial connector according to an embodiment of the present disclosure.
Figure 2:
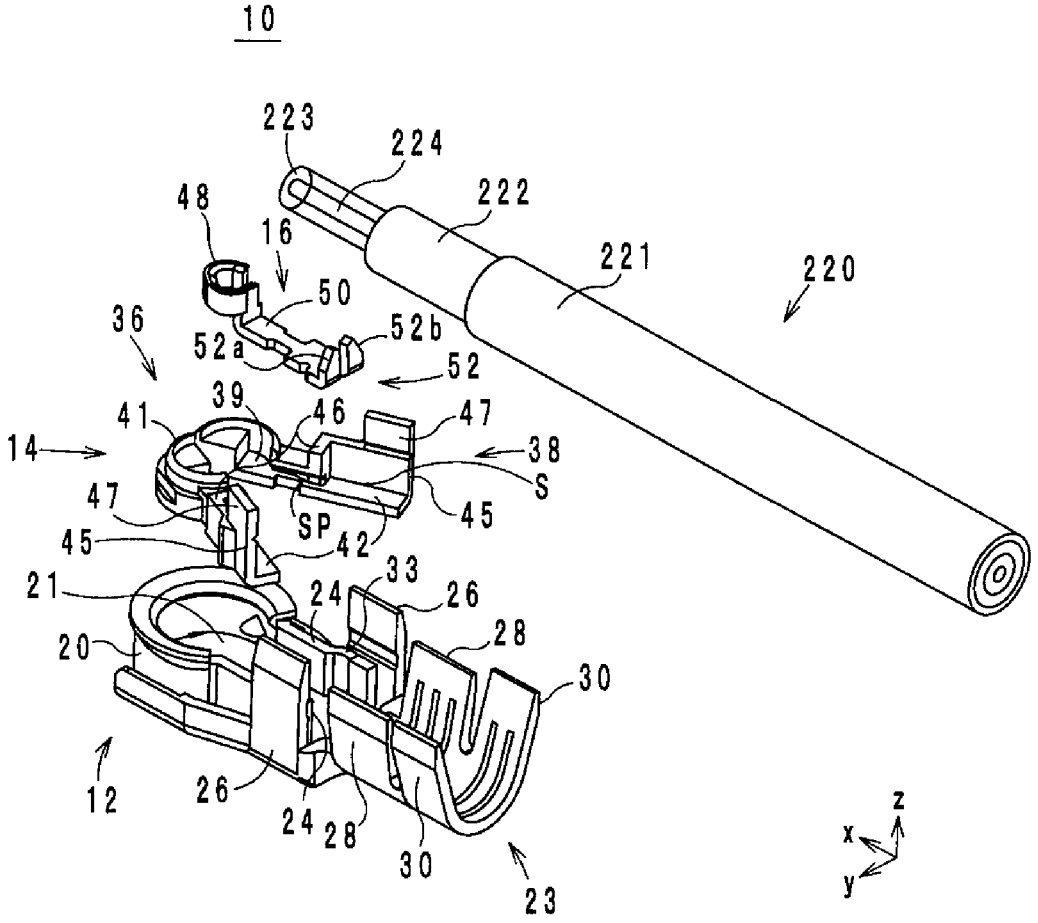
FIG. 2 is an exploded perspective view of a coaxial connector.
Figure 3A:
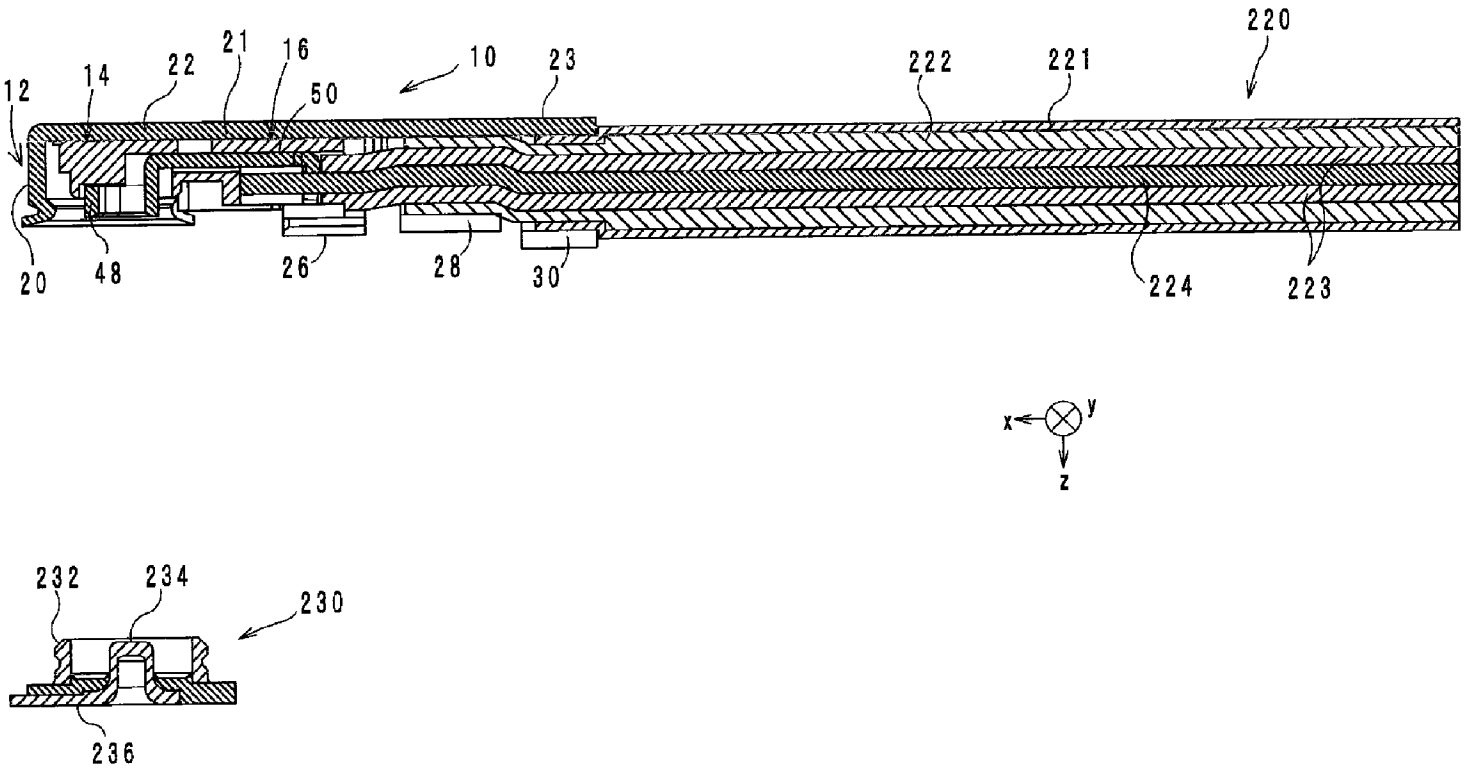
FIG. 3A is a cross-sectional structure view of a coaxial connector and a receptacle.
Figure 3B:
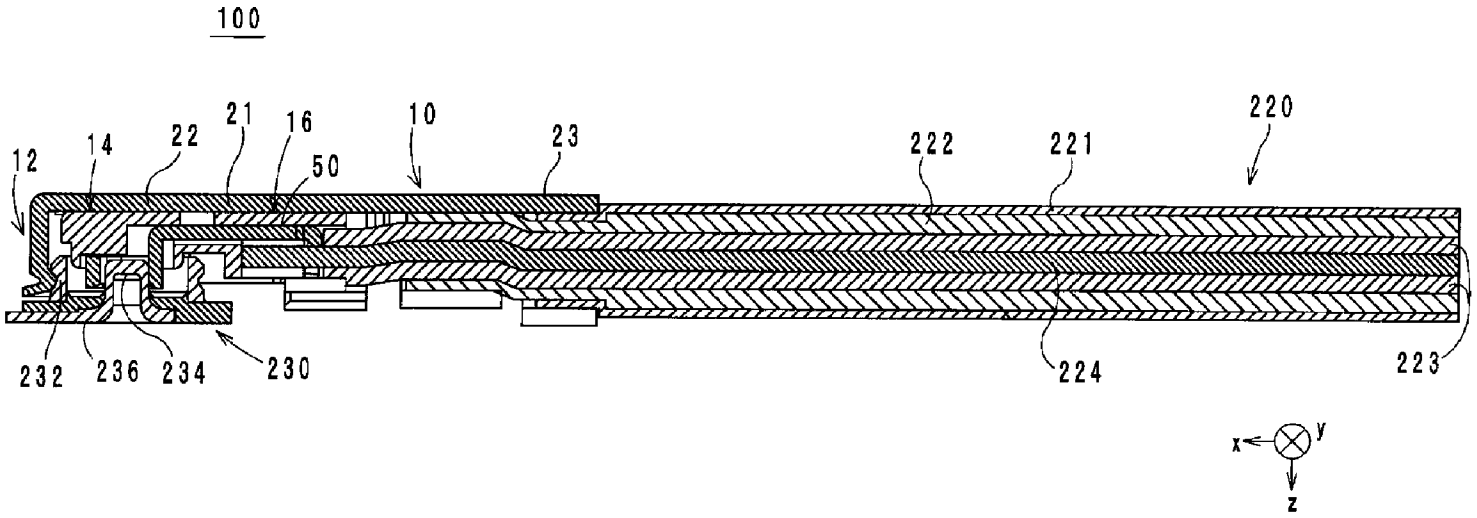
FIG. 3B is a cross-sectional structure view of a coaxial connector and a receptacle.
Figure 4:
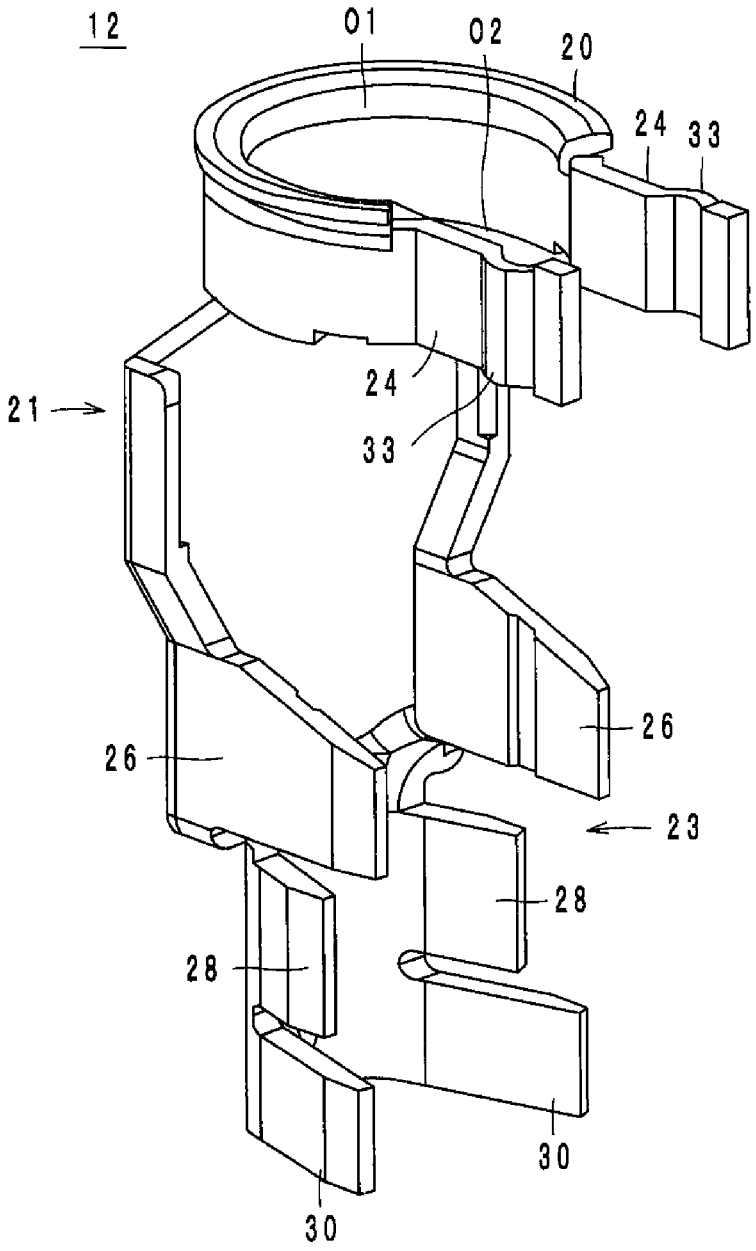
FIG. 4 is a perspective view of a housing of a coaxial connector halfway in the assembling thereof.
Figure 5:
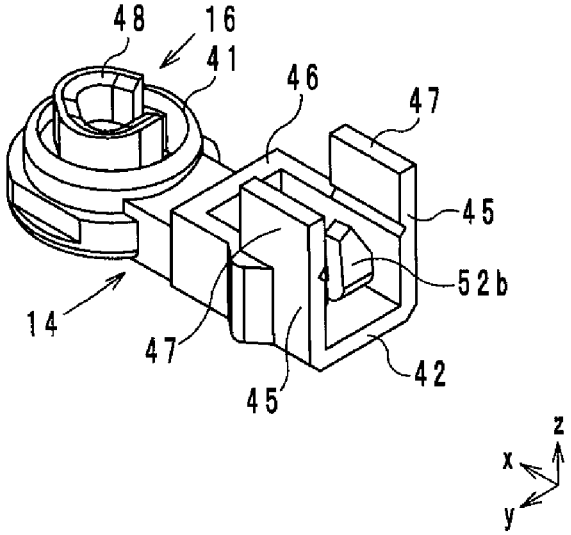
FIG. 5 is a perspective view when a socket is attached to a bushing.

FIG. 1 is an exterior appearance perspective view of a coaxial connector 10 according to an embodiment of the present disclosure. FIG. 2 is an exploded perspective view of the coaxial connector 10. FIG. 3A is a cross-sectional structure view of the coaxial connector 10 and a receptacle 230, and FIG. 3B is also a cross-sectional structure view of the coaxial connector 10 and the receptacle 230. FIG. 4 is a perspective view of a housing 12 of the coaxial connector 10 halfway in the assembling thereof. FIG. 5 is a perspective view when a socket is attached to a bushing 14. In FIGS. 1 through 5 (specifically, see FIG. 2), a direction in which the housing 12, the bushing 14, and the socket 16 are mounted sequentially is taken as a z-axis direction. The positive direction of the z-axis direction is a direction extending from the housing 12 toward the socket 16. A direction in which a coaxial cable 220 extends is taken as an x-axis direction, and a direction orthogonal to the x-axis direction and the z-axis direction is taken as a y-direction. The positive direction of the x-axis direction is a direction extending from the coaxial cable 220 toward the socket 16. The x-axis direction is orthogonal to the z-axis direction.

The coaxial connector 10 is constituted of, as shown in FIGS. 1 and 2, the housing 12, the bushing 14, and the socket 16. The coaxial connector 10 can be attached/detached to/from the receptacle 230 provided with an outer conductor 232, a central conductor 234, and a main body 236, as shown in FIGS. 3A and 3B.

The coaxial cable 220 is constituted of, as shown in FIG. 2, an insulation coat 221, an outer conductor 222, an insulator 223, and a central conductor 224. The insulator 223 is provided on a circumference of the central conductor 224, and has a foaming structure or a hollow structure. Accordingly, the insulator 223 exhibits only a low repulsive force, and is relatively easy to be deformed. The outer conductor 222 is provided on a circumference of the insulator 223. The insulation coat 221 is provided on a circumference of the outer conductor 222. Further, at a leading end of the coaxial cable 220, the insulation coat 221 is removed so that the outer conductor 222 is exposed. Furthermore, at the leading end of the coaxial cable 220, the outer conductor 222 is removed so that the insulator 223 is exposed.

The housing 12 is made of a single metal plate (for example, phosphor bronze for springs) and includes, as shown in FIGS. 2 and 4, a circular cylinder 20, a rear surface portion 21, a holder 23, and a fixing portion 24.

The circular cylinder 20 has a central axis extending in the z-axis direction, and includes an opening O1 positioned on the positive direction side of the z-axis direction and an opening O2 positioned on the negative direction side of the z-axis direction, as shown in FIG. 4. Note that, however, part of the circular cylinder 20 is cut out (part on the negative direction side of the x-axis direction). Hereinafter, a direction extending from the opening O1 toward the opening O2 is also called the negative direction of the z-axis direction. Likewise, a direction extending from the opening O2 toward the opening O1 is also called the positive direction of the z-axis direction.

The rear surface portion 21 is a plate member connected to the circular cylinder 20 and bent by 90 degrees from the state illustrated in FIG. 4 so as to cover the opening O2 of the circular cylinder 20, as shown in FIG. 2. The bushing 14 is placed on the rear surface portion 21.

Two fixing portions 24 are connected to the circular cylinder 20 and pinches the bushing 14 from both sides thereof in the y-axis direction, as shown in FIG. 2. The fixing portions 24 are provided at each end portion of the circular cylinder 20 in a plan view where the opening O1 is viewed from the positive direction side of the z-axis direction, as shown in FIG. 4. More specifically, the two fixing portions 24 are plate members opposing each other and respectively extending from two end portions, which are formed by cutting out the circular cylinder 20, toward the negative direction side of the x-axis direction.

Further, curved portions 33 are provided in each of the two fixing portions 24. The curved portions 33 are each formed by curving part of the fixing portion 24 toward the positive or negative direction side of the y-axis direction so as to widen a distance between the two fixing portions 24, as shown in FIGS. 2 and 4.

The holder 23 is provided, as shown in FIGS. 1 and 2, along the coaxial cable 220 from the circular cylinder 20; to be more specific, it is connected to the rear surface portion 21 on the negative direction side of the x-axis direction. As shown in FIG. 4, the holder 23 includes crimping portions 26, 28, and 30.

The crimping portion 26 is a belt-like member formed in a U shape and connected to the rear surface portion 21 on the negative direction side of the x-axis direction in a state before assembling the coaxial connector 10, as shown in FIG. 2. The crimping portion 26 is wound around the bushing 14, the fixing portions 24, and the insulator 223 so as to hold them by being bent as shown in FIG. 1. Through this, the crimping portion 26 is press-contacted to the bushing 14, the fixing portions 24, and the insulator 223. At this time, the fixing portions 24 are pushed by the crimping portion 26 and consequently press-contacted to the bushing 14. As such, the fixing portions 24 and the crimping portion 26 hold the bushing 14. As discussed thus far, the crimping portion 26 plays a role in fixing the bushing 14, the socket 16, and the coaxial cable 220 to the housing 12.

Here, both ends of the crimping portion 26 are positioned on the coaxial cable 220 when viewed from above in the central axis direction of the circular cylinder 20 (z-axis direction). Further, a side of the crimping portion 26 on the near side to the circular cylinder 20 is gradually distanced from the circular cylinder 20 as it progresses toward both the ends of the crimping portion 26. With this, the vicinity of both the ends of the crimping portion 26 in the above-mentioned side on the near side to the circular cylinder 20, is recessed toward the negative direction side of the x-axis direction so as to form a V shape when viewed from above in the z-axis direction, as illustrated in a part "A" in FIG. 1.

The crimping portion 28 is a belt-like member formed in a U shape and is provided on the negative direction side of the crimping portion 26 in the x-axis direction in a state before assembling the coaxial connector 10, as shown in FIG. 4. The crimping portion 28 is wound around the outer conductor 222 so as to hold the outer conductor 222 of the coaxial cable 220 by being bent as shown in FIG. 1. Through this, the crimping portion 28 plays a role in fixing the coaxial cable 220 to the housing 12 as well as a role in electrically connecting the outer conductor 222 and the housing 12 to each other.

The crimping portion 30 is a belt-like member formed in a U shape and is provided on the negative direction side of the crimping portion 28 in the x-axis direction in a state before assembling the coaxial connector 10, as shown in FIG. 4. The crimping portion 30 is wound around the insulation coat 221 so as to hold the insulation coat 221 of the coaxial cable 222 by being bent as shown in FIG. 1. Through this, the crimping portion 30 plays a role in fixing the coaxial cable 220 to the housing 12.

The bushing 14 is formed of an insulator made of resin (for example, liquid crystal polymer) and plays a role in insulating the housing 12 from the socket 16. The bushing 14 is attached to the housing 12 and constituted of a circular form portion 36 and a storage portion 38, as shown in FIG. 2.

The circular form portion 36 plays a role in holding the socket 16 and constituted of a rear surface portion 39 and a circular cylinder 41, as shown in FIG. 2. The rear surface portion 39 is a plate member that is formed in a circular shape when viewed from above in the z-axis direction, and is a portion stored inside the circular cylinder 20 when the bushing 14 is attached to the housing 12, as shown in FIG. 1.

The circular cylinder 41 is provided, as shown in FIG. 2, on a surface of the rear surface portion 39 on the positive direction side of the z-axis direction, and has a central axis extending in the z-axis direction. The central axis of the circular cylinder 41 and the central axis of the circular cylinder 20 substantially match each other. This makes the circular cylinder 41 be enclosed by the circular cylinder 20 when viewed from the positive direction side of the z-axis direction.

The storage portion 38 plays a role in holding the socket 16 and the leading end of the coaxial cable 220, and is constituted of a rear surface portion 42, a side surface portion 45, a pushing portion 46, and a cover portion 47, as shown in FIG. 2. The rear surface portion 42 is a plate member extending from the rear surface portion 39 of the circular form portion 36 toward the negative direction side of the x-axis direction. The socket 16 is placed on the rear surface portion 42 as shown in FIG. 2.

The pushing portion 46 is a plate member vertical with respect to the x-axis direction and is provided on the rear surface portion 42. Note that a space Sp is provided between an end portion of the pushing portion 46 on the negative direction side of the z-axis direction and a surface of the rear surface portion 42 on the positive direction side of the z-axis direction. Likewise, the space Sp is also provided between the circular cylinder 41 and the surface of the rear surface portion 42 on the positive direction side of the z-axis direction. With this, a space of the pushing portion 46 on the negative direction side of the x-axis direction (storage space S) and the interior of the circular cylinder 41 communicate with each other through the space Sp.

Two side surface portions 45 are plate members vertical with respect to the y-axis direction and provided on the rear surface portion 42 so as to oppose each other. One side surface portion 45 extends in the x-axis direction along a side of the rear surface portion 42 on the negative direction side of the y-axis direction, while the other side surface portion 45 extends in the x-axis direction along a side of the rear surface portion on the positive direction side of the y-axis direction. Further, end portions of two rear surface portions 42 on the positive direction side of the x-axis direction are jointed to both ends of the pushing portion 46 in the y-axis direction, respectively. Through this, the storage space S in which a surface on the positive direction side of the z-axis direction and a surface on the negative direction side of the x-axis direction are opened is formed in the storage portion 38. The leading end of the coaxial cable 220 is stored in the storage space S.

Two cover portions 47 are plate members formed in a rectangular shape and connected to each of the side surface portions 45 on the positive direction side of the z-axis direction. The cover portion 47 on the negative direction side of the y-axis direction can be bent toward the positive direction side of the y-axis direction, while the cover portion 47 on the positive direction side of the y-axis direction can be bent toward the negative direction side of the y-axis direction. This makes it possible for the cover portions 47 to cover part of the surface of the storage space S on the positive direction side of the z-axis direction. Note that, however, even in the case where the cover portions 47 are bent in the manner described above, half the surface of the storage space S on the positive direction side of the z-axis direction is opened on the positive direction side of the x-axis direction.

The bushing 14 can be isolated into two parts as shown in FIG. 2. To be more specific, the bushing 14 is separated into a half part on the positive direction side of the y-axis direction and a half part on the negative direction side of the y-axis direction while forming a V shape. This makes it possible for the socket 16, which will be explained later, to be attached to the bushing 14.

The socket 16 is made of a single metal plate (for example, phosphor bronze for springs), and as shown in FIGS. 1 and 2, is attached to the bushing 14 and isolated from the housing 12 by the bushing 14. The socket 16 is constituted of, as shown in FIG. 2, a circular cylinder 48, a rear surface portion 50, and an attachment portion 52.

As shown in FIG. 2, the circular cylinder 48 is connected to the rear surface portion 50 on the positive direction side of the x-axis direction, and has a shape in which part of a circular ring is cut out when viewed from above in the z-axis direction. Further, the circular cylinder 48 has a central axis extending in the z-axis direction. The central axis of the circular cylinder 48 substantially matches the central axes of the circular cylinders 20 and 41. The radius of the circular cylinder 48 is smaller than that of the circular cylinder 41 of the bushing 14. Accordingly, in the case where the coaxial connector 10 is assembled, as shown in FIG. 1, the circular cylinder 48 is enclosed by the circular cylinders 20 and 41 in a plan view from the positive direction side of the z-axis direction. Further, the circular cylinder 48 is positioned at the center of the circular cylinder 20 when viewed from above in the direction in which the central axis of the circular cylinder 20 extends (z-axis direction).

A height of the circular cylinder 48 from the rear surface portion 21 is higher than a height of the circular cylinder 41 from the rear surface portion 21, as shown in FIG. 5. This makes the circular cylinder 48 project from the circular cylinder 41 toward the positive direction side of the z-axis direction.

The rear surface portion 50 is a plate member extending toward the negative direction side of the x-axis direction so as to pass through the space Sp from the circular cylinder 41. The attachment portion 52 is provided being vertically bent, at an end portion of the rear surface portion 50 on the negative direction side of the x-axis direction, toward the positive direction side of the z-axis direction, and is connected to the central conductor 224 of the coaxial cable 220. More specifically, the attachment portion 52 is constituted of two cutter pieces 52*a* and 52*b* aligned with a predetermined gap provided therebetween. Then, the coaxial cable 220 is set so that the central conductor 224 is pinched in the predetermined gap between the cutter pieces 52*a* and 52*b*. Subsequently, crimping the crimping portion 26 causes the cover portions 47 to be press-contacted to the insulator 223 of the coaxial cable 220 by a force from the crimping portion 26. Through this, the coaxial cable 220 is pushed against the cutter pieces 52*a* and 52*b* from the positive direction side toward the negative direction side of the z-axis direction by a force from the cover portions 47. The cutter pieces 52*a* and 52*b* are press-contacted to the insulator 223 of the coaxial cable 220 by the force from the cover portions 47, and then a part of the insulator 223 of the coaxial cable 220 is cut by the cutter pieces 52*a* and 52*b* so as to be connected to the central conductor 224.

Here, with the crimping portion 26 being crimped, as shown in FIG. 1, the storage space S projects from the crimping portion 26 toward the circular cylinder 20 in a plan view from the positive direction side of the z-axis direction. This makes it possible to observe the leading end of the coaxial cable 220 through an opening in the surface of the storage space S on the positive direction side of the z-axis direction.

The coaxial connector 10 structured as discussed above is assembled through a procedure described hereinafter.

First, as shown in FIG. 5, the socket 16 is attached to the bushing 14. To be more specific, the socket 16 is pinched by the bushing 14 from both sides in the y-axis direction so that the circular cylinder 48 is accommodated inside the circular cylinder 41 and the rear surface portion 50 is accommodated in the space Sp.

Next, as shown in FIG. 2, the bushing 14 is attached to the housing 12. To be more specific, the bushing 14 is attached in a manner in which the bushing 14 is pushed into the housing 12 from the positive direction side of the z-axis direction so that the circular form portion 36 is accommodated inside the circular cylinder 20 and the storage portion 38 is accommodated between the fixing portions 24.

Subsequently, as shown in FIG. 2, the leading end of the coaxial cable 220 is placed in the storage portion 38 so that the leading end of the coaxial cable 220 is positioned on the attachment portion 52. In this case, the coaxial cable 220 has been processed so that the outer conductor 222 and the insulator 223 are exposed at the leading end thereof. Note that the central conductor 224 is not exposed. The coaxial cable 220 is placed in the socket 16 so that the insulator 223 is positioned on the attachment portion 52, the outer conductor 222 is positioned between the crimping portions 28, and the insulation coat 221 is positioned between the crimping portions 30.

Upon the coaxial cable 220 being placed, crimping processing of each of the crimping portions 26, 28, and 30 is carried out. In the crimping processing of the crimping portion 26, the cover portions 47 are pushed against the insulator 223 by bending the crimping portion 26. Through this, the insulator 223 is pushed against the cutter pieces 52*a* and 52*b*. At this time, part of the insulator 223 is cut by the cutter pieces 52*a* and 52*b* so that the cutter pieces 52*a* and 52*b* are connected to the central conductor 224.

In the crimping processing of the crimping portion 28, the crimping portion 28 is wound around the outer conductor 222 by bending the crimping portion 28. Likewise, in the crimping processing of the crimping portion 30, the crimping portion 30 is wound around the insulation coat 221 by bending the crimping portion 30. Through experiencing the above-described processing, the coaxial connector 10 is allowed to have the structure as illustrated in FIG. 1.

Next, a connecting section 100 will be described. The connecting section 100 includes, as shown in FIG. 3B, the coaxial connector 10 and the receptacle 230.

The coaxial connector 10 is mounted on the receptacle 230. The receptacle 230 is constituted of the outer conductor 232, the central conductor 234, and the main body 236, as shown in FIG. 3A. The main body 236 has a rectangular plate-like shape when viewed from above in the z-axis direction. The outer conductor 232 is an electrode formed in a circular cylinder shape and projects from the main body 236 toward the negative direction side of the z-axis direction. The central conductor 234 is an electrode that is positioned at the center of the outer electrode 232 and projects from the main body 236 toward the negative direction side of the z-axis direction.

When the coaxial connector 10 is mounted on the receptacle 230, the outer conductor 232 is inserted into the circular cylinder 20 through the opening O1, as shown in FIGS. 3A and 3B. Through this, an inner circumference surface of the circular cylinder 20 makes contact with an outer circumference surface of the outer conductor 232 so that the outer conductor 222 of the coaxial cable 220 and the outer conductor 232 of the receptacle 230 are electrically connected to each other through the housing 12. At this time, the circular cylinder 20 is widened outward by the outer conductor 232. This causes the inner circumference surface of the circular cylinder 20 to be press-contacted to the outer circumference surface of the outer conductor 232, thereby preventing the coaxial connector 10 from being easily dismounted from the receptacle 230.

At the same time of the outer conductor 232 being inserted into the circular cylinder 20, as shown in FIGS. 3A and 3B, the central conductor 234 is inserted into the circular cylinder 48 of the socket 16. This causes an outer circumference surface of the central conductor 234 to make contact with an inner circumference surface of the circular cylinder 48 so that the central conductor 224 of the coaxial cable 220 and the central conductor 234 of the receptacle 230 are electrically connected to each other through the socket 16.

Note that the coaxial connector 10 is so structured as to be capable of rotating relative to the receptacle 230. Hereinafter, the above structure will be described referring to the drawings. FIGS. 6 through 9 are diagrams each illustrating a state in which the coaxial connector 10 is rotated.

Figure 6:
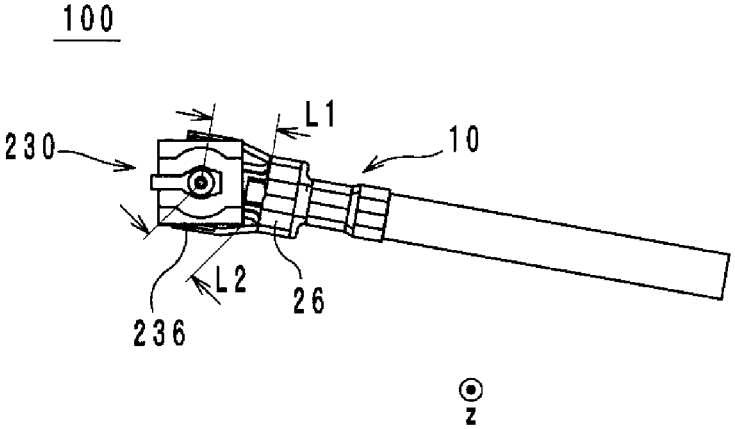
FIG. 6 is a diagram illustrating a state in which a coaxial connector is rotated.
Figure 7:
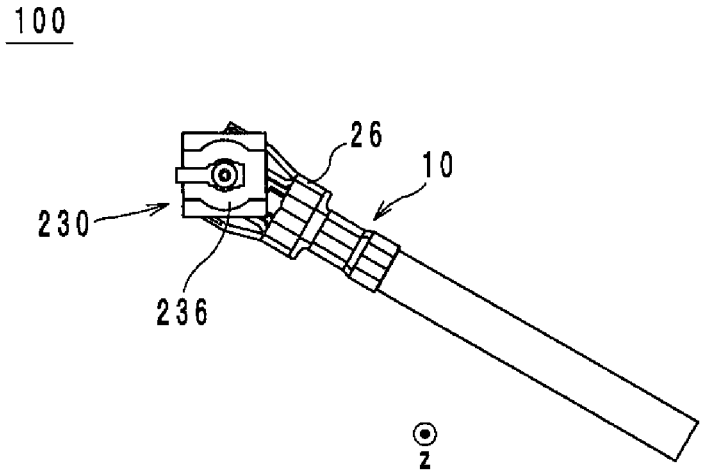
FIG. 7 is a diagram illustrating a state in which the coaxial connector is rotated.
Figure 8:
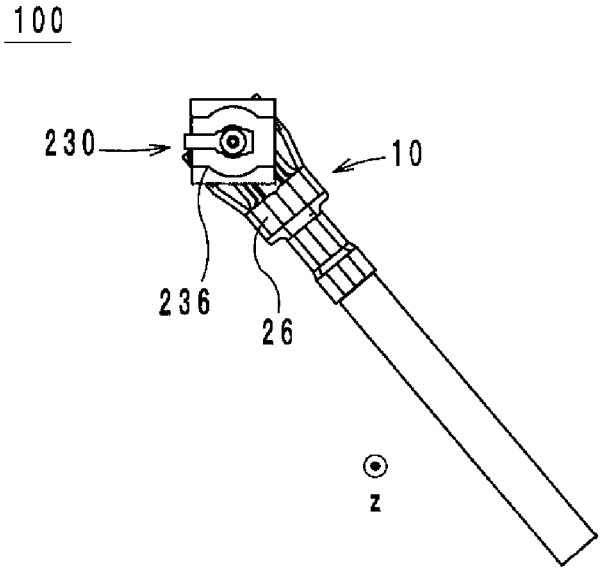
FIG. 8 is a diagram illustrating a state in which the coaxial connector is rotated.
Figure 9:
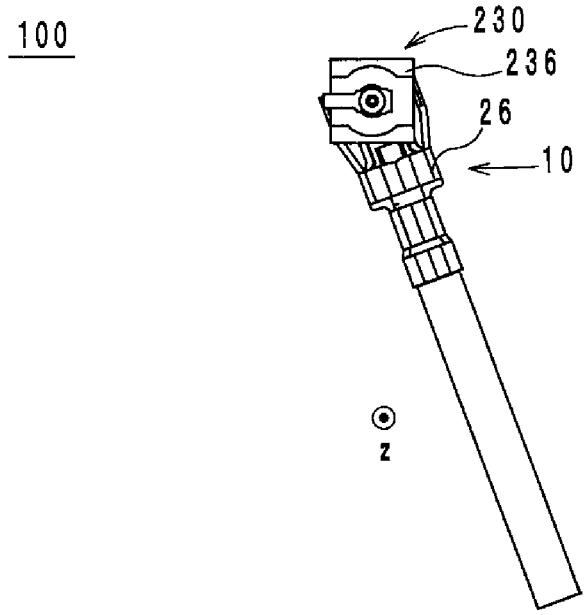
FIG. 9 is a diagram illustrating a state in which the coaxial connector is rotated.

As shown in FIG. 6, a minimum length L1, in the coaxial connector 10, from the center of the circular cylinder 20 to the crimping portion 26 when viewed from above in the z-axis direction is longer than a maximum length L2 from the center of the outer conductor 232 to an outer edge of the main body 236 of the receptacle 230 when viewed from above in the z-axis direction. More specifically, the crimping portion 26 is formed in a rectangular shape extending in the y-axis direction when viewed from above in the z-axis direction. The nearest part of the crimping portion 26 to the center of the circular cylinder is the center of a side of the crimping portion 26 on the positive direction side of the x-axis direction. In the present embodiment, the above-mentioned part corresponds to a position where both the ends of the crimping portion 26 are in contact with each other. Accordingly, the minimum length L1 from the center of the circular cylinder 20 to the crimping portion 26 when viewed from above in the z-axis direction is a length from the center of the circular cylinder 20 to the center of the side of the crimping portion 26 on the positive direction side of the x-axis direction.

The main body 236 of the receptacle 230 is formed in a square shape when viewed from above in the z-axis direction. Accordingly, in the outer edge of the main body 236, a portion most distanced from the center of the outer conductor 232 is a corner of the main body 236 when viewed from above in the z-axis direction. As such, the maximum length L2 from the center of the outer conductor 232 to the outer edge of the main body 236 of the receptacle 230 when viewed from above in the z-axis direction is a length from the center of the outer conductor 232 to the corner of the main body 236.

As discussed thus far, because a relationship of the minimum length L1>the maximum length L2 holds, the corner of the receptacle 230 does not make contact with the crimping portion 26 when the coaxial connector 10 is rotated relative to the receptacle 230, as shown in FIGS. 6 through 9. This makes it possible to rotate the coaxial connector 10 by 360 degrees relative to the receptacle 230.

(Effects)

According to the coaxial connector 10 and the connecting section 100 being structured in the above-discussed manner, the coaxial connector 10 can be rotated relative to the receptacle 230 as described above.

Further, as will be described below, the connecting section 100 can be reduced in height. The minimum length L1 from the center of the circular cylinder 20 to the crimping portion 26 when viewed from above in the z-axis direction is longer than the maximum length L2 from the center of the outer conductor 232 to the outer edge of the main body 236 of the receptacle 230 when viewed from above in the z-axis direction. Because of this, the crimping portion 26 of the coaxial cable 10 does not overlap with the main body 236 of the receptacle 230 in the z-axis direction. As such, as shown in FIG. 3B, the highest part of the crimping portion 26 on the positive direction side of the z-axis direction can be set at a position which is higher, on the positive direction side of the z-axis direction, than the surface of the main body 236 on the negative direction side of the z-axis direction. In other words, the crimping portion 26 and the main body 236 overlap with each other in the x-axis direction, whereby the height of the circular cylinder 20 in the z-axis direction can be made lower than the height of the crimping portion 26 in the z-axis direction. Accordingly, the height of the connecting section 100 constituted of the coaxial connector 10 and the receptacle 230 can be lowered in the z-axis direction when the coaxial connector 10 is mounted on the receptacle 230.

Note that as shown in FIG. 1, the storage space S projects from the crimping portion 26 toward the circular cylinder 20 in a plan view from the positive direction side of the z-axis direction. This makes it possible for an excess portion of the insulator 223 to stick out from the storage space S in a portion where the storage space S projects from the crimping portion 26 when the crimping portion 26 is crimped. As such, the crimping portion 26 can be firmly crimped. It is preferable for the insulator 223 sticking out from the storage space S to be positioned on the negative direction side of the z-axis direction relative to the circular cylinder 20 so as not to interfere with the rotation of the coaxial connector 10.

The circular cylinder 48 of the socket 16 is higher than the circular cylinder 41 of the bushing 14. Because of this, in the case of mounting the coaxial cable 10 on the receptacle 230, the circular cylinder 41 is suppressed from making contact with the central conductor 234 when the central conductor 234 of the receptacle 230 is inserted into the circular cylinder 48. In other words, the bushing 14 is suppressed from interfering with the mounting of the coaxial cable 10 on the receptacle 230.

Further, the circular cylinder 41 of the bushing 14 encloses the circular cylinder 48 of the socket 16, whereby expansion of the circular cylinder 48 is restricted by the circular cylinder 41 when the central conductor 234 is inserted into the circular cylinder 48. This suppresses the circular cylinder 48 from making contact with the circular cylinder 20 of the housing 12 due to an excessive expansion of the circular cylinder 48. As such, a short circuit between the circular cylinder 48 and the circular cylinder 20 is suppressed from occurring when the coaxial connector 10 is mounted on the receptacle 230 or when the coaxial connector 10 is dismounted from the receptacle 230.

Further, a side of the crimping portion 26 on the near side to the circular cylinder 20 is gradually distanced from the circular cylinder 20 as the circular cylinder progresses toward both the ends of the crimping portion 26. With this, the vicinity of both the ends of the side of the crimping portion 26 on the near side to the circular cylinder 20 is recessed toward the negative direction side of the x-axis direction so as to form a V shape when viewed from above in the z-axis direction, as illustrated in part A in FIG. 1. The vicinity of both the ends of the side of the crimping portion 26 on the near side to the circular cylinder 20 is, as discussed before, the nearest part of the crimping portion 26 to the center of the circular cylinder 20. This makes it possible to more surely prevent the crimping portion 26 from making contact with the main body 236 of the receptacle 230.

INDUSTRIAL APPLICABILITY

As discussed thus far, the present disclosure can be usefully applied to coaxial connectors and connecting sections, and is particularly excellent in a point that the coaxial connector can be rotated relative to the receptacle.

The invention claimed is:

1. A coaxial connector that is attached to a leading end of a coaxial cable including an outside conductor and a second central conductor insulated from each other with an insulation film, and that is attachable/detachable to/from a receptacle including a first central conductor and an outer conductor which is formed in a circular cylinder shape and is provided on a circumference of the first central conductor, comprising:

a housing;

a bushing which is attached to the housing and on which the leading end of the coaxial cable is placed; and a socket attached to the bushing and insulated from the housing by the bushing, wherein the housing includes a first circular cylinder and a crimping portion holding the bushing, the bushing is press-contacted to the insulation film by a force from the crimping portion, the socket includes a contact portion enclosed by the first circular cylinder and an attachment portion that is press-contacted to the insulation film by a force from the bushing and is connected to the second central conductor through cutting and removing part of the insulation film, the first circular cylinder is fitted onto the outer conductor and the contact portion is connected to the first central conductor, a minimum length from a center of the first circular cylinder to an end of the crimping portion closest to the center of the first circular cylinder when viewed from above in a central axis direction of the first circular cylinder is longer than a maximum length from a center of the outer conductor to an outer edge of the receptacle when viewed from above in a central axis direction of the outer conductor, the housing further includes a rear surface portion, and the crimping portion is connected to the rear surface portion, and fixes the bushing to the housing by being wound around the bushing.

2. The coaxial connector according to claim 1, wherein the first circular cylinder includes a first opening and a second opening through which the outer conductor is inserted, and the rear surface portion covers the second opening.

3. The coaxial connector according to claim 2, wherein the crimping portion is a belt-like metal piece, both ends of the crimping portion are positioned on the coaxial cable when viewed from above in the central axis direction of the first circular cylinder, and a side of the crimping portion on a near side to the first circular cylinder is gradually distanced from the first circular cylinder as the first circular cylinder progresses toward both the ends of the crimping portion.

4. The coaxial connector according to claim 3, wherein the outside conductor is removed at the leading end of the coaxial cable, the bushing includes a storage portion forming a storage space which has an opened surface on a side of a direction extending from the second opening toward the first opening, and in which the leading end of the coaxial cable is stored, and the storage space projects from the crimping portion toward the first circular cylinder when viewed from above in the central axis direction of the first circular cylinder.

5. The coaxial connector according to claim 2, wherein the bushing includes a second circular cylinder that is enclosed by the first circular cylinder when viewed from above in the central axis direction of the first circular cylinder, the second circular cylinder encloses the contact portion when viewed from above in the central axis direction of the first circular cylinder, and a height of the contact portion from the rear surface portion is higher than a height of the second circular cylinder from the rear surface portion.

6. A connecting section comprising:

the coaxial connector according to claim 1; and the receptacle on which the above coaxial connector is mounted.

* * * * *